US007780370B2

(12) United States Patent
Blumberg

(10) Patent No.: US 7,780,370 B2
(45) Date of Patent: Aug. 24, 2010

(54) ENVIRONMENTALLY FRIENDLY BINDING OF CALENDARS

(75) Inventor: Murray Blumberg, Gauteng (ZA)

(73) Assignee: Slideco NV, Curacoa (NL)

( * ) Notice: Subject to any disclaimer, the term of this patent is extended or adjusted under 35 U.S.C. 154(b) by 1166 days.

(21) Appl. No.: 11/187,556

(22) Filed: Jul. 22, 2005

(65) Prior Publication Data

US 2006/0059733 A1 Mar. 23, 2006

Related U.S. Application Data

(60) Provisional application No. 60/592,921, filed on Jul. 30, 2004.

(51) Int. Cl.
*B42F 11/00* (2006.01)
*B42F 23/00* (2006.01)

(52) U.S. Cl. ..... 402/80 R; 283/2; 402/500; 40/107

(58) Field of Classification Search ..... 412/8, 412/9, 16, 34, 901; 283/2; D19/20; 40/107, 40/109; 402/8, 70, 80 P, 80 R, 500
See application file for complete search history.

(56) References Cited

U.S. PATENT DOCUMENTS 1,074,271 A * 9/1913 Kingsey ..... 281/21.1
1,843,771 A * 2/1932 Kline ..... 402/79
1,881,736 A * 10/1932 Lichter ..... 40/617
1,906,024 A * 4/1933 Todd ..... 40/107
2,074,606 A * 3/1937 Elliot ..... 312/184
2,285,447 A * 6/1942 Lichter ..... 156/521
2,387,808 A * 10/1945 Pruneau et al. ..... 281/21.1
2,647,711 A * 8/1953 Margulis ..... 248/467
3,199,888 A * 8/1965 Rowland ..... 280/18
3,350,045 A * 10/1967 Mayers ..... 248/205.3
RE28,758 E * 4/1976 Decker ..... 281/21.1
4,009,784 A * 3/1977 Elias et al. ..... 211/46
4,077,078 A * 3/1978 Snellman et al. ..... 412/4
4,595,309 A * 6/1986 Chinchar ..... 402/80 R (Continued)

FOREIGN PATENT DOCUMENTS

DE 686982 1/1940

(Continued)

OTHER PUBLICATIONS

PCT International Search Report, PCT/IB2005/002255, Mar. 2, 2006, 7 pgs.

(Continued)

*Primary Examiner*—Dana Ross
*Assistant Examiner*—Pradeep C Battula
(74) *Attorney, Agent, or Firm*—Wood, Herron & Evans, LLP

(57) ABSTRACT

A calendar binder having a rigid bar with a front surface and a rear surface, a recess centrally positioned on the rear surface of the rigid bar, a tab having a top end and a bottom end, and an adhesive layer on the rear surface of the rigid bar is adapted to secure the rigid bar to a calendar where at least a portion of the tab is positioned in the recess of the rigid bar. The respective materials for the rigid bar, the tab and the adhesive are suitable biodegradable materials.

23 Claims, 3 Drawing Sheets

U.S. PATENT DOCUMENTS

| | | | | |
|---|---|---|---|---|
| 6,042,319 | A * | 3/2000 | Hoffman | 412/34 |
| 6,444,286 | B1 * | 9/2002 | MacKenzie | 428/99 |
| D522,053 | S * | 5/2006 | Gavronsky | D19/20 |
| 2004/0114989 | A1 * | 6/2004 | Gavronsky | 402/70 |
| 2009/0096203 | A1 * | 4/2009 | Blumberg | 283/2 |

FOREIGN PATENT DOCUMENTS

| | | | |
|---|---|---|---|
| DE | 2119747 | | 11/1972 |
| DE | 2503678 | | 5/1976 |
| DE | 2818453 | | 8/1979 |
| DE | 8702515 | | 9/1987 |
| DE | 19815387 | | 7/1999 |
| JP | 07228074 | A * | 8/1995 |
| JP | 2001297507 | A * | 9/1999 |
| WO | 2004/016449 | | 2/2004 |

OTHER PUBLICATIONS

PCT Written Opinion of the International Searching Authority, PCT/IB2005/002255, Mar. 2, 2006, 8 pgs.

* cited by examiner

ENVIRONMENTALLY FRIENDLY BINDING OF CALENDARS

CROSS-REFERENCE TO RELATED APPLICATIONS

The application claims the benefit of U.S. Provisional Patent Application No. 60/592,921 filed on Jul. 30, 2004, and hereby incorporated by reference in its entirety.

FIELD OF THE INVENTION

This invention relates to binding of calendars in an environmentally friendly manner. More particularly it relates to an environmentally friendly calendar binder, a supply of such binders, a calendar having such a binder, a method of binding a calendar in an environmentally friendly manner and an apparatus for performing the method.

BACKGROUND OF THE INVENTION

Wall calendars and similar reference planners and charts are usually attached to a wall by means of a permanent fastener, e.g., a nail or picture hanger, or with an adhesive such as two-sided tape. The hanger mechanism is usually attached to the binding that holds the pages of the calendar together. At the end of any month the calendar has to be changed to the next month. Then, at year end, the consumers are expected to throw the calendars away and buy new ones, making calendars disposable items.

Currently binding strips for calendars are manufactured from metal sheets or other rigid materials. These strips are then attached to the calendars to bind the calendar pages together. The calendar pages are typically some type of paper material. When the calendars are discarded at the end of the year and replaced with new calendars, the old calendars are thrown away with other garbage and then taken to land fills. The paper material typically making up the pages of the calendar biodegrades very quickly compared to the binders that are made of metal or other materials that are either not biodegradable or biodegrade very slowly. Therefore, disposable calendars that are friendlier to the environment and biodegrade quickly are needed.

SUMMARY OF THE INVENTION

The invention addresses this and other problems associated with the prior art and existing solutions by providing an environmentally friendly calendar assembly, that utilizes biodegradable materials in the calendar binding and hanger to allow for the entire calendar to biodegrade quickly and not contribute to overflowing landfills or garbage disposal locations.

The invention solves the problem by utilizing a calendar binder in one embodiment that includes a rigid bar, a recess that is centrally positioned on the rear surface of the rigid bar, a tab positioned in the recess of the rigid bar, and an adhesive layer on the rear surface of the rigid bar adapted to secure the rigid bar to a calendar. The calendars are bound using a method of binding calendars that includes stocking a binding machine with a supply of calendar binders having a biodegradable rigid bar as explained above, separating a calendar binder from the supply of calendar binders, mounting the calendar binder to a calendar, and preparing the supply of calendar binders to separate the next binder.

The supply of calendar binders can be provided from a magazine or from a roll of calendar binders that includes a core, a sheet of material, and a plurality of rigid bars wherein the rigid bars are attached to the material at spaced intervals, and wherein the material with the rigid bars is wound onto the core forming a roll or a reel of binders. The tabs are precut from the fabric on the roll. The roll may be scored or perforated at appropriate intervals between the rigid bars to assist in separating the calendar binders from the roll with out having to cut the roll.

From the foregoing disclosure and the following more detailed description of various preferred embodiments, those skilled in the art will realize that this invention provides a significant advance in the technology of calendar binding. Particularly significant in this regard is the potential the invention offers for providing calendar binders and a method of attaching the binders that is friendly to the environment. Additional features and advantages of various preferred embodiments will be better understood in view of the detailed description provided below.

BRIEF DESCRIPTION OF THE DRAWINGS

These and further features of this invention will be apparent with reference to the following description and drawings wherein.

Figure 1:
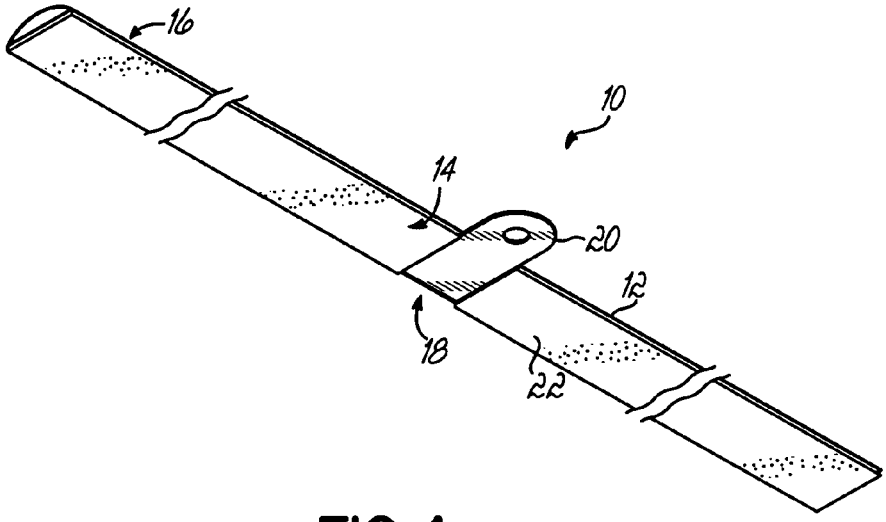
FIG. 1 shows a perspective view from below of a first embodiment of an environmentally friendly binder for a calendar in accordance with the invention.

The appended drawings are not necessarily to scale, presenting a somewhat simplified representation of various features illustrative of the basic principles of the invention. The specific design features of the calendar binders as disclosed herein, including, for example, specific dimensions, orientations, locations, and shapes of various components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF CERTAIN PREFERRED EMBODIMENTS

According to a first aspect of the invention, an environmentally friendly binder for a calendar includes a rigid bar of a suitably biodegradable material and a securing mechanism for securing the bar to a sheet or a stack of sheets. The bar may be of wood, cardboard, other plant material, or a suitable biodegradable synthetic plastic material. The bar may have a hanger attached thereto. The hanger may be of a flexible material and may also be readily biodegradable.

The securing mechanism may be an adhesive. The adhesive may be a pre-applied coating on a surface of the bar. Alternatively, the adhesive may be applied to the bar, or the sheet(s), when the bar is mated with the sheet(s). The securing mechanism may also include a piece of a flexible flat securing material fastened to the bar. The securing material may be fabric or cloth like, and may be natural or artificial materials. The securing material may project from one or both sides of the bar. The piece of securing material may be secured to the sheet(s) forming the calendar by adhesive. As mentioned above, this adhesive could be pre-applied or applied when the calendar sheet(s) is/are being bound. The securing material may be a strip running along the length of the bar or it may be a plurality of tabs projecting from the bar. This securing material may be fastened to the front or rear surface of the bar.

Conveniently, the securing material may be part of a sheet and the tabs may be parts of ribbons. A number of the bars might attach to the sheet or the ribbons, at spaced intervals, and then the sheet, or the ribbons might be cut or parted to provide the binder. Thus, a supply of binders may include a plurality of the bars attached at spaced intervals to a length of a flexible flat securing material. The securing material with the bars attached thereto, may be rolled up to provide a roll or reel of the binders and to facilitate separation of the binders when they are parted from the roll or reel.

Further according to the invention, a calendar may have a binder in accordance with the invention. The invention extends to a method of binding a calendar in a environmentally friendly manner, which includes securing the rigid bar of a suitably biodegradable material to a sheet of the calendar. The bar may be adhesively secured to the sheet. In particular, the bar may be fastened with a flexible flat securing material, which is adhesively secure to the calendar sheet. As indicated above, a supply of binders may be provided in reel or roll form and the method may then include cutting or parting the securing material to separate a binder from the roll or reel, and then securing the material to the calendar sheet(s).

Further, as indicated above, adhesive for securing the securing material to the sheet(s) may be pre-applied. In this event, the pre-applied adhesive may be activated by a number of means depending solely on the type of adhesive being used. For example, if the adhesive is heat sensitive, it may be heated just prior to attaching the calendar binder to the calendar sheets. Alternative, the method may include applying the adhesive to the securing material and/or the calendar sheet(s).

The invention extends still further to an apparatus for binding a calendar in an environmentally friendly manner, which includes a mechanism for providing a binder having a rigid bar of a suitably biodegradable material and a securing mechanism for securing the bar to a sheet, or stack of sheets, forming the calendar. The apparatus may have an adhesive activating mechanism for activating a coating of adhesive on the bar or on a piece of a flexible, flat, securing material fast with the bar. Alternative, the apparatus may have an adhesive applicator for applying a layer of adhesive to the bar to the securing material. In the case where the binder has a piece of securing material, the apparatus may have a folding arrangement for folding the securing material over, or around the sheet(s). When the binders are provided in reel or roll form, the apparatus may have a support for the reel or roll and a cutting or parting mechanism for cutting or parting binders from the roll as they are required, and a feeding mechanism for feeding them into mating contact with the sheet(s).

Figure 2:
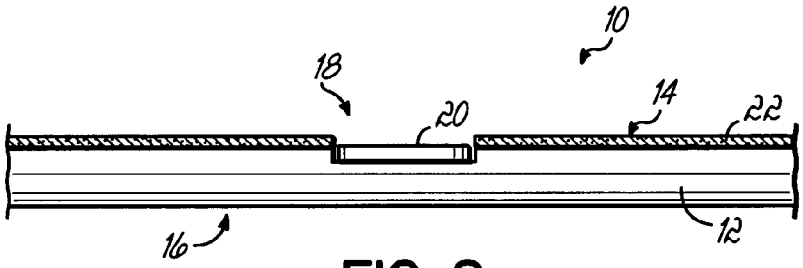
FIG. 2 shows a detailed side view of a central portion of the binder of FIG. 1.

Referring now to FIGS. 1 and 2, a first embodiment of an environmentally friendly binder for a calendar, in accordance with the invention, is designated generally by reference numeral 10. The binder 10 includes a rigid bar 12 of wood. As shown, the bar 12 has a flat rear surface 14 and a curved front surface 16. For a typical wall calendar the bar might have a length between 15 cm and 92 cm and a width of about 7 mm and a thickness of about 1.5 mm. A recess 18 is centrally positioned on the rear surface 14. A hanger 20 is located in the recess 18 and formed from fabric or a synthetic plastics material. The hanger 20 is glued to the bar 12. A layer 22 of a heat activatable adhesive is included on the rear surface 14 of the bar 12.

Figure 3:
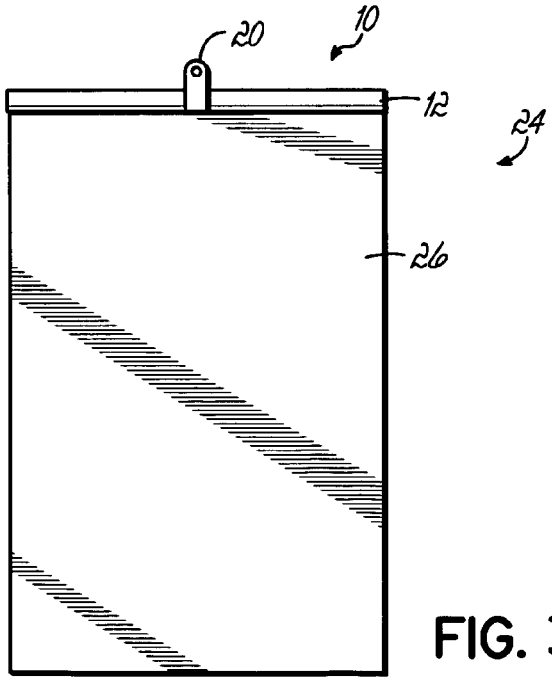
FIG. 3 shows a single sheet calendar bound by the binder of FIG. 1.

In use, with a single sheet calendar 24, such as is shown in FIG. 3, the bar 12 is glued to an upper edge of a sheet of paper or cloth 26, with the hanger 20 projecting therefrom. The binder 10 is bound to the sheet 26 by an apparatus (not shown), which has a magazine containing one or more binders 10 to supply binders positioned into a mating configuration, a heating arrangement for heating the adhesive layer, and a pressure arrangement for pressing the bar 12 against the sheet 26, to adhere it thereto. The heating arrangement may heat the adhesive 22 either before it is mated with the sheet 26, or after.

Figure 4:
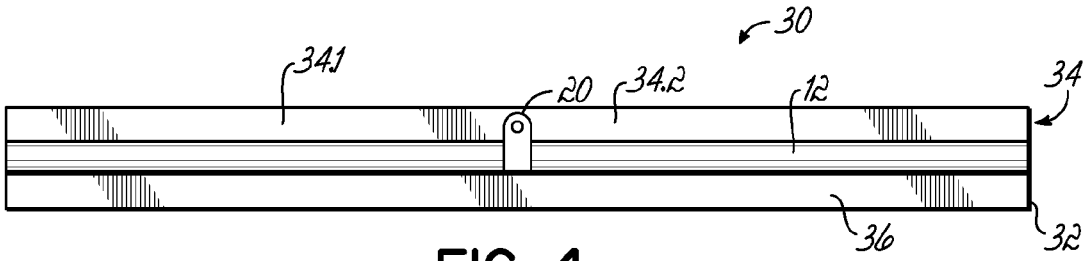
FIG. 4 shows a plan view of a second embodiment of an environmentally friendly binder for a calendar, also in accordance with the invention.
Figure 5:
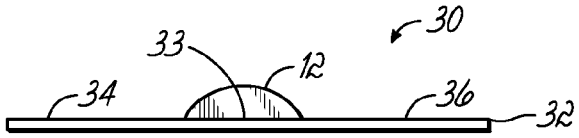
FIG. 5 shows an end, enlarged view of the binder of FIG. 4.

Referring now to FIGS. 4 and 5, a second embodiment of an environmentally friendly binder 30 for a calendar is shown. This binder 30 also has a bar 12 that might be made of wood. It further has a narrow piece 32 of fabric-like material which is glued at 33 to the rear surface of the bar 12, such that there is an upper strip 34 above the bar 12 and a lower strip 36 below the bar 12. The hanger 20 is cut out of the upper strip 34 to provide a left upper strip 34.1 and a right upper strip 34.2

Figure 6:
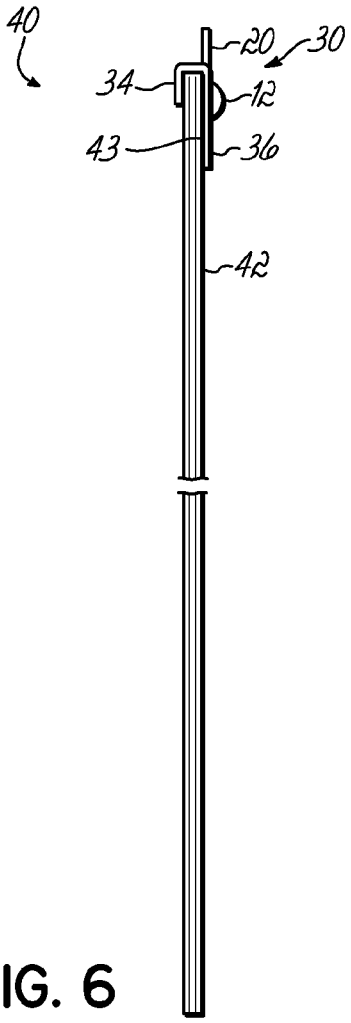
FIG. 6 shows a side view of a multi-sheet calendar bound by the binder of FIG. 4.

In use, as shown in FIG. 6, a multi-sheet calendar 40 has the binder 30 and a bundle 42 of sheets. The binder 40 is secured to the bundle 42 with the bar 12 aligned with a top edge of the bundle 42. The upper left and right strips 34.1 and 34.2, the lower strip 36 and the strip of material underlying the bar 12 are adhered to the bundle 42 by a suitable adhesive 43. The sheets of the bundle could be presecured together by staples, "padding", or the like. As with the earlier example, the adhesive 43 may be pre-applied or applied immediately prior to use.

Figure 7:
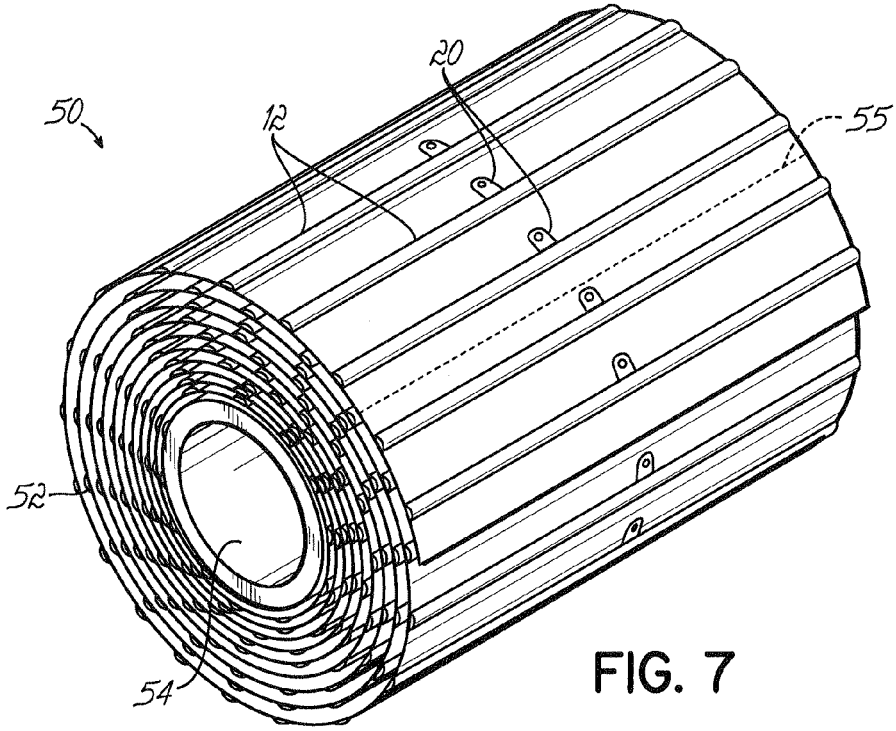
FIG. 7 shows schematically a roll of the binders of FIG. 4.

The binders 30 may be supplied from a magazine, as with the first embodiment or they may be provided as a roll 50, as shown in FIG. 7. Thus, a sheet 52 of the material is provided with the bars 12 secured thereto at spaced intervals and with hangers 20 cut out of the material. The sheet is then wound onto a core 54. The sheet 52 is then cut appropriately between adjacent bars 12 to provide the binders 30. A parting line could be defined by a line of weakness or perforations 55 so that a binder 30 may be parted from the roll by a parting mechanism, without having to be cut.

Figure 8:
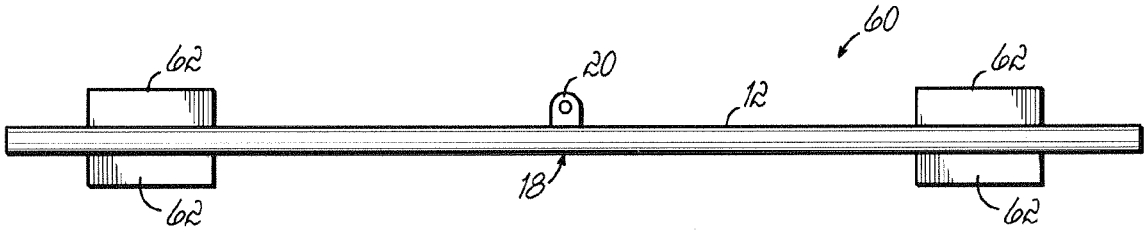
FIG. 8 shows a plan view of a third embodiment of an environmentally friendly binder for a calendar, also in accordance with the invention.

Referring now to FIG. 8, a further embodiment 60 of an environmentally friendly binder in accordance with the invention is shown. This binder 60 is similar in some respects to the binder 10 of FIGS. 1 and 2 in that it has a bar 12 with a hanger 20 in a central recess 18. It is also similar to the binder 30 of FIGS. 4 and 5 in that it has tabs 62 close to both ends and projecting above and below, with the upper tabs 62 being wrapped over a bundle of sheets in the same way as the upper strips 34. The tabs 62 may also be in recesses 18. The exposed portions of the rear surface of the bar 12 and the underneath surfaces of the tabs 62 may be adhesively secured to the sheet(s) forming the calendar. This embodiment may also be supplied in roll form, with the tabs 62 being pieces of ribbons.

Figure 9:
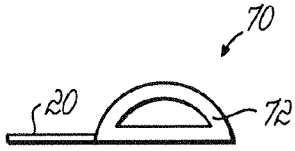
FIG. 9 shows a side view of a fourth embodiment of an environmentally friendly binder for a calendar, also in accordance with the invention.

Referring finally to FIG. 9, a still further embodiment 70 of an environmentally friendly binder for a calendar is shown. This embodiment 70 has an extruded hollow bar 72 that is made of a readily biodegradable synthetic plastics material and a hanger 20.

From the forgoing disclosure and detailed description of certain illustrated embodiments, various modifications, additions, and other alternative embodiments are possible without departing from the true scope and spirit of this invention. For example, the rigid bar can each have many different sizes and shape to accommodate various types of calendars. The embodiments that are disclosed were chosen and described to provide the best illustration of the principles of this invention and its practical application to thereby enable one of ordinary skill in the art to utilize the invention in various embodiments and with various modifications as are suited to particular uses. All such modifications and variations are within the scope of this invention as determined by the appended claims when interpreted in accordance with the benefit to which they are fairly, legally, and equitably entitled.

What is claimed is:

1. A roll of calendar binders comprising:

a core;

a sheet of material wound onto the core; and a plurality of rigid bars attached to the material at spaced intervals, wherein: the rigid bars are attached to the material so as to leave a longitudinal surface of each of the rigid bars exposed outwardly, away from the core when the material and the rigid bars are wound onto the core.

2. The roll of calendar binders of claim 1 wherein at least one of the plurality of rigid bars and the sheet of material are non-metallic.

3. The roll of calendar binders of claim 1 wherein at least one of the plurality of rigid bars includes a material selected from the group consisting of wood, cardboard, plant materials and biodegradable synthetic plastic materials.

4. The roll of calendar binders of claim 1 wherein each of the plurality of rigid bars has a length dimension oriented transverse to a direction of winding of the material.

5. The roll of calendar binders of claim 1 further comprising:

a line of weakness in the material being appropriately spaced between each pair of two adjacent rigid bars.

6. A roll of calendar binders comprising:

a core;

a sheet of material;

a plurality of rigid bars attached to the material at spaced intervals, wherein the material with the rigid bars is wound onto the core and the rigid bars are attached to the material so as to leave a longitudinal surface of each of the rigid bars exposed; and a line of weakness in the material being appropriately spaced between each pair of two adjacent rigid bars.

7. The roll of calendar binders of claim 6 further comprising:

a plurality of hangers each attached to one of the rigid bars.

8. The roll of calendar binders of claim 6 wherein the sheet of material and plurality of rigid bars are biodegradable materials.

9. A calendar apparatus comprising:

a rigid bar having a front longitudinal surface and a generally flat rear surface opposite the front surface;

a flexible strip attached to the rear surface of the rigid bar and extending beyond a perimeter of the rigid bar;

a tab having a top end and a bottom end wherein at least a portion of the tab projects from the rigid bar; and an adhesive layer on the rear surface of the rigid bar securing the rigid bar to the flexible strip so as to leave the front longitudinal surface of the rigid bar exposed.

10. The calendar apparatus of claim 9 wherein the respective materials for the rigid bar, the flexible strip, the tab and the adhesive are biodegradable materials.

11. The calendar apparatus of claim 9 further comprising:

an adhesive layer on a rear surface of the flexible strip; and a calendar having an upper edge which is attached to the rear surface of the flexible strip via the adhesive layer thereon.

12. The calendar apparatus of claim 11 wherein the calendar includes a plurality of sheets and the flexible strip binds the plurality of sheets.

13. The calendar apparatus of claim 9 further comprising:

a hole extending through the top end of the tab.

14. The calendar apparatus of claim 9 wherein the tab is formed from the flexible strip.

15. The calendar apparatus of claim 9 wherein the adhesive is a heat activatable adhesive.

16. The calendar binder of claim 9 wherein the front surface of the rigid bar is a curved surface thereby defining a generally D-shaped cross-sectional shape of the rigid bar.

17. The calendar apparatus of claim 9 wherein the flexible strip further comprises:

an upper first part, an upper second part and a lower part, the flexible strip being attached to the rigid bar and the bottom end of the tab being attached to the rigid bar between the upper first part and upper second part of the flexible strip.

18. The calendar apparatus of claim 17 further comprising:

a calendar having a first surface, a second surface, and an upper edge, the calendar containing a plurality of sheets and the rigid bar being aligned with the upper edge of the calendar, the lower flexible strip is attached to the first surface of the calendar, and the upper first part and upper second part of the flexible strip are wrapped over the top edge of the calendar and attached to the second surface of the calendar.

19. The calendar apparatus of claim 9 wherein the flexible strip further comprises:

a first flexible strip having an upper part and a lower part, the first flexible strip being attached to the rigid bar toward an end of the rigid bar; and a second flexible strip having an upper part and a lower part, the second flexible strip being attached to the rigid bar toward an opposite end of the rigid bar along a length thereof from the first flexible strip.

20. The calendar apparatus of claim 19 further comprising:

a calendar having a first surface, a second surface and an upper edge, the calendar containing a plurality of sheets, the rigid bar being aligned with the upper edge of the calendar, the lower first and second flexible strips being attached to the first surface of the calendar, and the upper first and second flexible strips are wrapped over the top edge of the calendar and attached to the second surface of the calendar.

21. The calendar apparatus of claim 9 wherein the rigid bar further comprises an extruded hollow bar made of a readily biodegradable synthetic plastic material.

22. The calendar apparatus of claim 9 wherein the rigid bar is non-metallic.

23. The calendar apparatus of claim 9 wherein the rigid bar includes a material selected from the group consisting of wood, cardboard, plant materials and biodegradable synthetic plastic materials.

* * * * *